US010727607B2

(12) United States Patent
Luo et al.

(10) Patent No.: US 10,727,607 B2
(45) Date of Patent: Jul. 28, 2020

(54) HORN ANTENNA

(71) Applicant: HUAWEI TECHNOLOGIES CO., LTD., Shenzhen, Guangdong (CN)

(72) Inventors: Xin Luo, Chengdu (CN); Yi Chen, Chengdu (CN); Tinghai Lv, Chengdu (CN)

(73) Assignee: Huawei Technologies Co., Ltd., Shenzhen (CN)

( * ) Notice: Subject to any disclaimer, the term of this patent is extended or adjusted under 35 U.S.C. 154(b) by 0 days.

(21) Appl. No.: 16/159,494

(22) Filed: Oct. 12, 2018

(65) Prior Publication Data

US 2019/0051990 A1 Feb. 14, 2019

Related U.S. Application Data

(63) Continuation of application No. PCT/CN2016/101595, filed on Oct. 9, 2016.

(51) Int. Cl.
*H01Q 19/13* (2006.01)
*H01Q 19/19* (2006.01)
(Continued)

(52) U.S. Cl.
CPC ..... *H01Q 19/19* (2013.01); *H01Q 13/02* (2013.01); *H01Q 15/0013* (2013.01);
(Continued)

(58) Field of Classification Search
CPC ..... H01Q 15/0013; H01Q 19/132; H01Q 19/134; H01Q 19/19; H01Q 19/191; H01Q 15/0033
See application file for complete search history.

(56) References Cited

U.S. PATENT DOCUMENTS 3,231,892 A * 1/1966 Matson ..... H01Q 15/0013 343/775
4,017,865 A * 4/1977 Woodward ..... H01Q 15/0033 343/781 CA
(Continued)

FOREIGN PATENT DOCUMENTS

CN 201758183 U 3/2011
CN 102394374 A 3/2012
(Continued)

OTHER PUBLICATIONS

Li, "The Research of Dual-band Modified Cassegrain Antenna with Polarized-twist," A Master Thesis Submitted to University of Electronic Science and Technology of China, Mar. 2016, 81 pages (with partial English translation).
(Continued)

*Primary Examiner* — AB Salam Alkassim, Jr.
(74) *Attorney, Agent, or Firm* — Fish & Richardson P.C.

(57) ABSTRACT

The present application discloses a horn antenna, including a frequency selective surface (FSS), a connection structure, and a waveguide tube. The connection structure includes a first dielectric slab, a second dielectric slab, and a dielectric wall, which jointly form a hollow structure. A first surface of the first dielectric slab is a hyperboloid whose surface is protruding, a second surface of the first dielectric slab is connected to the dielectric wall. The dielectric wall has a tubular structure, a first surface of the dielectric wall is covered by the first dielectric slab, a second surface of the dielectric wall is covered by the second dielectric slab. There is a hole at a middle position of the second dielectric slab. The FSS covers the first surface of the first dielectric slab. A part of the waveguide tube is inserted into the hole of the second dielectric slab.

7 Claims, 4 Drawing Sheets

(51) Int. Cl.
*H01Q 15/00* (2006.01)
*H01Q 13/02* (2006.01)
*H01Q 19/10* (2006.01)

(52) U.S. Cl.
CPC ..... *H01Q 19/10* (2013.01); *H01Q 19/132* (2013.01); *H01Q 19/191* (2013.01)

(56) References Cited

U.S. PATENT DOCUMENTS 4,897,663 A * 1/1990 Kusano ..... H01Q 13/0266 343/786
5,373,302 A * 12/1994 Wu ..... H01Q 15/0033 343/781 CA
6,091,365 A 7/2000 Derneryd et al.
6,121,939 A * 9/2000 Imaizumi ..... H01Q 1/247 343/840
8,212,734 B1 * 7/2012 Matyas ..... H01Q 19/18 343/781 P
9,379,457 B2 * 6/2016 Shiue ..... H01Q 25/04
9,509,059 B2 * 11/2016 Roberts ..... H01Q 13/20
9,893,417 B2 * 2/2018 Paleta, Jr. ..... H04B 7/18517
2003/0214456 A1 * 11/2003 Lynch ..... H01Q 15/0026 343/909
2003/0234745 A1 12/2003 Choung et al.
2005/0030242 A1 * 2/2005 Hirota ..... H01Q 1/40 343/786
2006/0125705 A1 6/2006 Nagano
2007/0109212 A1 5/2007 Wu et al.
2010/0238082 A1 * 9/2010 Kits van Heyningen ..... H01Q 3/08 343/761
2010/0245187 A1 * 9/2010 Omuro ..... H01Q 19/021 343/702
2011/0156844 A1 6/2011 Wakabayashi et al.
2013/0009846 A1 * 1/2013 Freitag ..... H01Q 1/281 343/872
2013/0207859 A1 * 8/2013 Legay ..... H01Q 1/405 343/756
2014/0182370 A1 * 7/2014 Kienzle ..... G01F 23/284 73/290 V
2014/0292605 A1 * 10/2014 Roberts ..... H01Q 13/20 343/781 CA
2014/0375517 A1 * 12/2014 Shiue ..... H01Q 25/04 343/776
2015/0009083 A1 * 1/2015 Shiue ..... H01Q 13/02 343/776
2015/0301254 A1 * 10/2015 Metcalfe ..... G02B 5/3066 359/485.01
2016/0226136 A1 * 8/2016 Paleta, Jr. ..... H04B 7/18517
2016/0226150 A1 * 8/2016 Paleta, Jr. ..... H01Q 19/19
2016/0226151 A1 * 8/2016 Paleta, Jr. ..... H01Q 19/19
2016/0226152 A1 * 8/2016 Paleta, Jr. ..... H01Q 19/191
2016/0226153 A1 * 8/2016 Paleta, Jr. ..... H01Q 19/191
2017/0264020 A1 * 9/2017 Jackson ..... H01Q 15/0013

FOREIGN PATENT DOCUMENTS

CN 202487779 U 10/2012
CN 104025383 A 9/2014
CN 105870641 A 8/2016
EP 2590264 A1 5/2013
EP 3051626 A1 8/2016
EP 2565984 B1 8/2019
JP 07226623 A 8/1995
JP 2001512640 A 8/2001
JP 2006166301 A 6/2006
JP 2007096868 A 4/2007
JP 2013066152 A 4/2013
JP 2014533026 A 12/2014
JP 2015179977 A 10/2015
KR 100976535 BI 8/2010
WO 2010023827 A1 3/2010

OTHER PUBLICATIONS

Office Action issued in Chinese Application No. 201680082894.0 dated Oct. 9, 2019, 17 pages (with English translation).
Search Report issued in Chinese Application No. 201680082894.0 dated Sep. 25, 2019, 3 pages.
Extended European Search Report in European Appln. No. 1618168.2, dated Apr. 23, 2019, 12 pages.
International Search Report and Written Opinion issued in International Application No. PCT/CN2016/101595 dated May 24, 2017, 12 pages.
Office Action issued in Japanese Application No. 2019-529307 dated Dec. 24, 2019, 8 pages (with English translation).

* cited by examiner

HORN ANTENNA

CROSS-REFERENCE TO RELATED APPLICATIONS

This application is a continuation of International Application No. PCT/CN2016/101595, filed on Oct. 9, 2016, the disclosure of which is hereby incorporated by reference in its entirety.

TECHNICAL FIELD

The present application relates to the field of wireless communications technologies, and in particular, to a horn antenna that can be used in a dual-band parabolic antenna.

BACKGROUND

With rapid development of wireless communications technologies, a transmission capacity in microwave point-to-point communication continuously increases, and an E-band (71 to 76 GHz, 81 to 86 GHz) frequency band microwave device plays an increasingly important role in a base station backhaul network. However, because "rain fade" on an E-band frequency band electromagnetic wave is extremely severe, an E-band microwave single-hop distance is usually less than 3 kilometers. To increase the E-band microwave single-hop distance and reduce site deployment costs, a solution is provided, in which the E-band frequency band microwave device and another low frequency microwave device are cooperatively used. When there is relatively heavy rain, even if the E-band microwave device cannot normally work, the low frequency microwave device can still normally work.

A dual-band parabolic antenna is used in this solution, and a structure is shown in FIG. 1. The dual-band parabolic antenna includes a primary reflector, a secondary reflector, a low frequency feed, and a high frequency feed. Both the low frequency feed and the high frequency feed are a type of horn antenna, and are usually referred to as a horn feed when being applied to another antenna structure. The two feeds share the primary reflector. A frequency selective surface (, FSS) is used as the secondary reflector. The secondary reflector is designed as a hyperboloid, a virtual focus of the hyperboloid and a real focus of the primary reflector are overlapped, and the feeds of different frequencies are respectively disposed at the virtual focus and a real focus of the hyperboloid. The secondary reflector transmits an electromagnetic wave transmitted by the low frequency feed located at the virtual focus, and reflects an electromagnetic wave transmitted by the high frequency feed located at the real focus, so as to implement a dual-band multiplexing function.

In the prior art, a low frequency horn feed and an FSS are two independent components. Therefore, there are problems that a large assembly error exists, an antenna gain is low, and a beam direction deviates from a boresight axis direction.

SUMMARY

Embodiments of the present invention provide a horn antenna, which integrates functions of a low frequency horn feed and an FSS, so as to resolve prior-art problems that a large assembly error causes a low antenna gain, and a beam direction deviates from a boresight axis direction.

According to a first aspect, a horn antenna is provided, and includes a frequency selective surface FSS, a connection structure, and a waveguide tube, where the connection structure includes a first dielectric slab, a second dielectric slab, and a dielectric wall, a first surface of the first dielectric slab is a hyperboloid whose surface is protruding, a second surface of the first dielectric slab is connected to the dielectric wall, a spacing between the two surfaces of the first dielectric slab is a thickness of the first dielectric slab, the dielectric wall has a tubular structure, a first surface of the dielectric wall is covered by the first dielectric slab, a second surface of the dielectric wall is covered by the second dielectric slab, a spacing between the two surfaces of the dielectric wall is a height of the dielectric wall, an area of the first surface of the dielectric wall is not less than an area of the second surface of the dielectric wall, there is a hole at a middle position of the second dielectric slab, and the first dielectric slab, the dielectric wall, and the second dielectric slab jointly form a hollow structure; the FSS covers the first surface of the first dielectric slab; and a part of the waveguide tube is inserted into the hole of the second dielectric slab.

The horn antenna provided in the embodiments of the present invention integrates functions of the FSS and the low frequency horn feed, so as to greatly reduce an error of alignment with a high frequency horn feed, reduce an assembly difficulty, and further provide relatively high radiation frequency.

With reference to the first aspect, in a first possible implementation of the first aspect, an array arrangement direction of the FSS is 45 degrees or 135 degrees to a polarization direction of an incident electromagnetic wave. This can reduce a side lobe height of an electromagnetic wave transmitted through the FSS, thereby reducing a degradation degree of a beam shape of the electromagnetic wave.

With reference to the first aspect, in a second possible implementation of the first aspect, the thickness of the first dielectric slab is half of a wavelength corresponding to a first frequency in the first dielectric slab, and the first frequency is a transmission band center frequency of the FSS. In the embodiments of the present invention, reflection of the transmitted electromagnetic wave from a front facet of the first dielectric slab is mutually offset with that from a back facet of the first dielectric slab, and therefore, transmission bandwidth of the FSS at a low frequency band is increased.

With reference to the first aspect, or the first or the second possible implementation of the first aspect, in a third possible implementation of the first aspect, another part of the waveguide tube is inserted into the hollow structure.

With reference to the third possible implementation of the first aspect, in a fourth possible implementation of the first aspect, the horn antenna further includes a choke groove located around the waveguide tube inserted into the hollow structure, a groove depth of the choke groove is ¼ of a wavelength corresponding to the first frequency in the air, and the first frequency is the transmission band center frequency of the FSS. In the embodiments of the present invention, energy of an electromagnetic wave can be radiated forward in a more concentrated manner, to improve the radiation efficiency of the horn antenna.

With reference to the fourth possible implementation of the first aspect, in a fifth possible implementation of the first aspect, there is more than one choke groove, and a spacing between the grooves is 1/10 of the wavelength corresponding to the first frequency in the air. In the embodiments, the horn antenna includes multiple choke grooves, so as to further improve the radiation efficiency of the horn antenna.

In the solutions provided in the embodiments of the present invention, a horn antenna integrates functions of an FSS and a low frequency horn feed, so as to greatly reduce an error of alignment with a high frequency horn feed, and reduce an assembly difficulty. In addition, the horn antenna provided in the embodiments of the present invention further provides relatively high radiation efficiency.

BRIEF DESCRIPTION OF DRAWINGS

To describe the technical solutions in the embodiments of the present invention or in the prior art more clearly, the following briefly describes the accompanying drawings required for describing the embodiments or the prior art. Apparently, the accompanying drawings in the following description show merely some embodiments of the present invention, and a person of ordinary skill in the art may still derive other drawings from these accompanying drawings without creative efforts.

DESCRIPTION OF EMBODIMENTS

The following clearly describes the technical solutions in the embodiments of the present invention with reference to the accompanying drawings in the embodiments of the present invention. Apparently, the described embodiments are a part rather than all of the embodiments of the present invention. All other embodiments obtained by a person of ordinary skill in the art based on the embodiments of the present invention without creative efforts shall fall within the protection scope of the present invention.

In the following description, to illustrate rather than limit, specific details such as a particular system structure, an interface, and a technology are provided to make a thorough understanding of the present invention. However, a person skilled in the art should know that the present invention may be practiced in other embodiments without these specific details. In other cases, detailed descriptions of well-known apparatuses, circuits, and methods are omitted, so that the present invention is described without being obscured by unnecessary details.

It should be understood that ordinal numbers such as "first" and "second", if mentioned in the embodiments of the present invention, are only used for distinguishing, unless the ordinal numbers definitely represent a sequence according to the context.

To facilitate understanding of a person skilled in the art, the following embodiments are used in the present invention to describe the technical solutions provided in the present invention.

Figure 1:
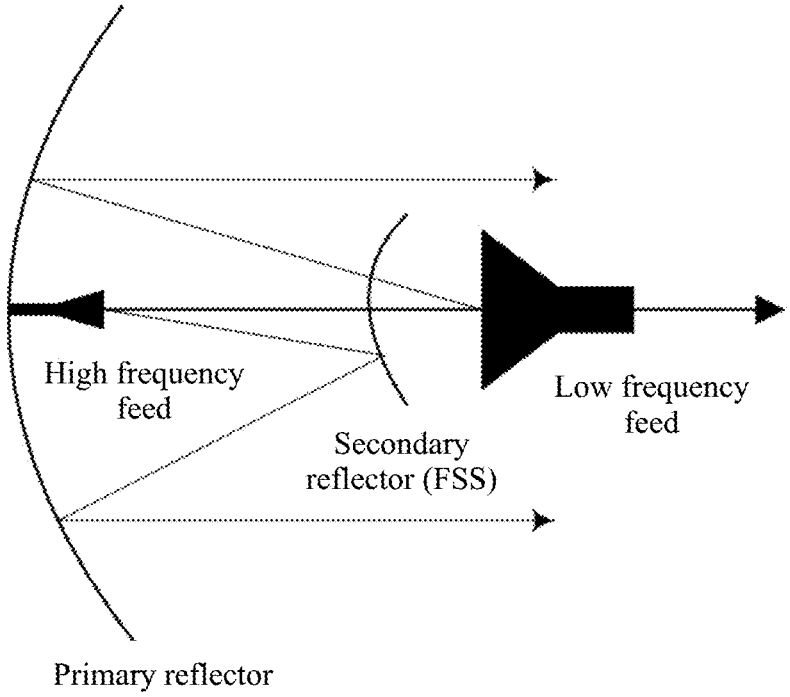
PRIOR ART FIG. 1
FIG. 1 is a schematic structural diagram of an existing dual-band parabolic antenna.
Figure 2:
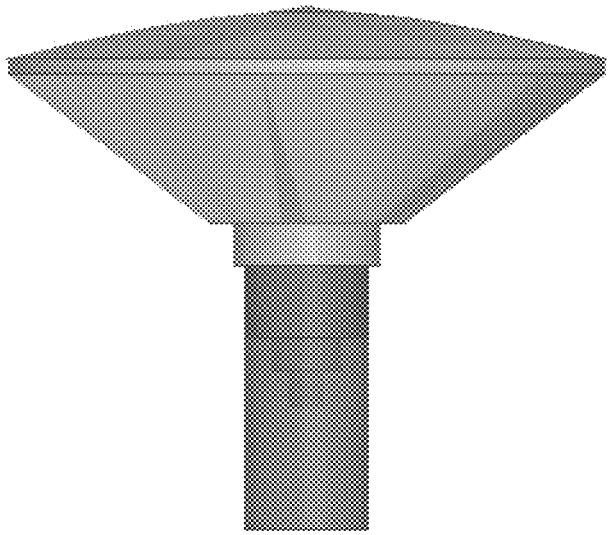
FIG. 2 is a schematic structural diagram of an existing horn antenna.

As known to all, a horn antenna is a widely used antenna. Both a low frequency feed and a high frequency feed in FIG. 1 are horn antennas. An existing horn antenna generally includes a solid dielectric block and a waveguide tube. As shown in FIG. 2, the solid dielectric block is a cone with a curved-surface top, and a tip opposite to the curved-surface top is inserted into the waveguide tube and is connected to the waveguide tube, to form a horn feed. However, in an existing dual-band parabolic antenna, an FSS and a low frequency horn feed (a horn antenna used in an antenna structure is usually referred to as a horn feed) are two independent components. This results in a large assembly error, and further causes problems that an antenna gain is reduced, and a beam direction deviates from a boresight axis direction.

Figure 3:
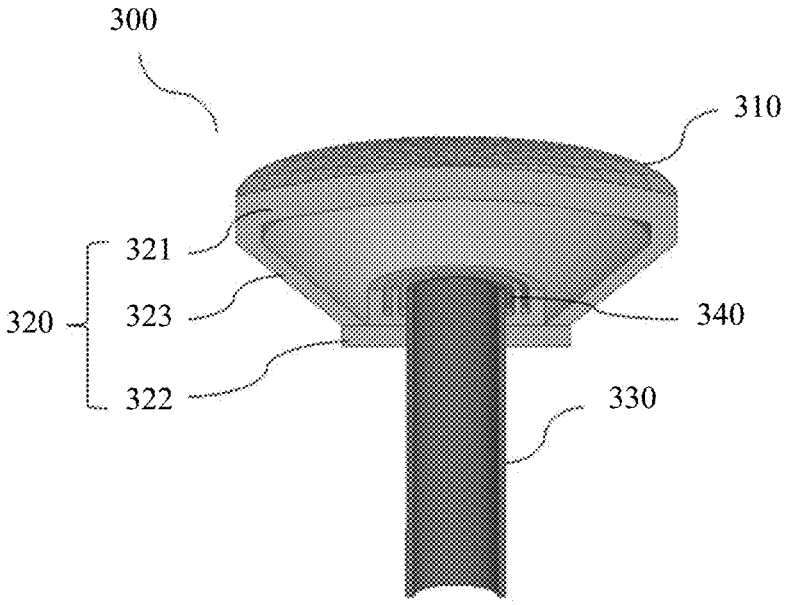
FIG. 3 is a schematic structural diagram of a horn antenna according to an embodiment of the present invention.

An embodiment of the present invention provides a horn antenna 300. The horn antenna integrates functions of an FSS and a low frequency horn feed. A structure of the horn antenna is shown in FIG. 3, and includes an FSS 310, a connection structure 320, and a waveguide tube 330.

The connection structure 320 includes a first dielectric slab 321, a second dielectric slab 322, and a dielectric wall 323. A first surface of the first dielectric slab 321 is a hyperboloid whose surface is protruding, a second surface of the first dielectric slab 321 is connected to the dielectric wall 323, and a spacing between the two surfaces of the first dielectric slab 321 is a thickness of the first dielectric slab 321. The dielectric wall 323 has a tubular structure, a first surface of the dielectric wall 323 is covered by the first dielectric slab 321, a second surface of the dielectric wall is covered by the second dielectric slab 322, a spacing between the two surfaces of the dielectric wall 323 is a height of the dielectric wall 323, and an area of the first surface of the dielectric wall 323 is not less than an area of the second surface of the dielectric wall 323. There is a hole at a middle position of the second dielectric slab 322. The first dielectric slab 321, the dielectric wall 323, and the second dielectric slab 322 jointly form a hollow structure. The FSS 310 covers the first surface of the first dielectric slab 321. A part of the waveguide tube 330 is inserted into the hole of the second dielectric slab 322.

It should be understood that an area of the hole of the second dielectric slab 322 is consistent with a cross-sectional area of the waveguide tube 330, and the second dielectric slab and the waveguide tube 330 are tightly combined, and play a connection part. The dielectric wall 323 has a tubular structure, and may be in a shape of a cylinder, a horn, or the like. In addition, a material with a relatively low transmission electromagnetic wave loss needs to be used for the first dielectric slab 321, and a dielectric material in an existing horn antenna may be used. The second dielectric slab and the dielectric wall mainly play a support part, and a hard material may be used. These are not limited in this embodiment of the present invention.

The FSS 310 in this embodiment of the present invention has functions of transmitting a low frequency band electromagnetic wave and reflecting a high frequency band electromagnetic wave. Any existing FSS having the foregoing functions may be used, and this is not limited in this embodiment of the present invention.

Figure 4:
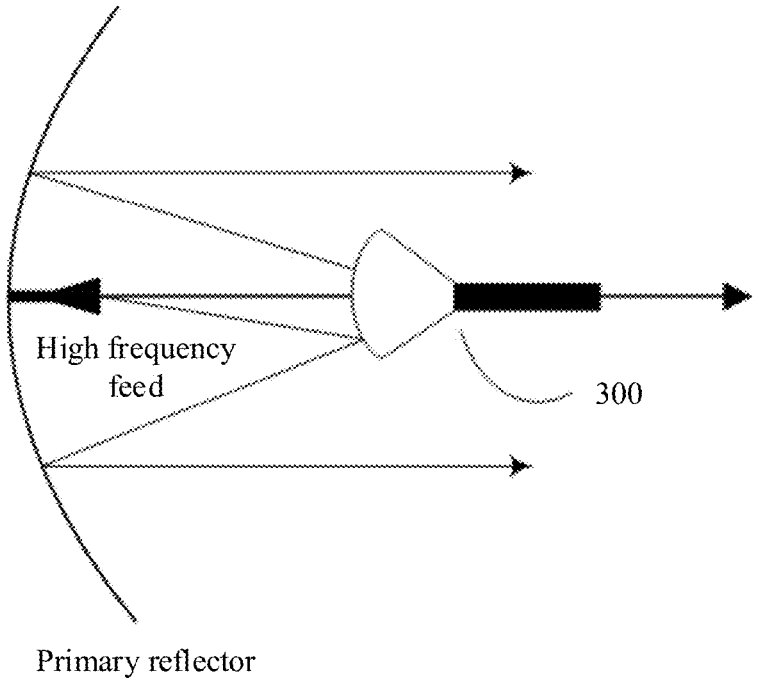
FIG. 4 is a schematic structural diagram of a dual-band parabolic antenna applying an embodiment of the present invention.

FIG. 4 shows a dual-band parabolic antenna applying the horn antenna 300 provided in this embodiment of the present invention. It can be learned from the figure that the horn antenna 300 provided in this embodiment of the present invention integrates the functions of the FSS and the low frequency feed, and only alignment between the horn antenna 300 and a high frequency horn feed needs to be considered. This implements a function of reducing an alignment error, and can control the alignment error within a range from −0.2 mm to +0.2 mm. In addition, propagation of an electromagnetic wave in a dielectric can be reduced as much as possible by using the connection structure 320 with the hollow structure. Because a transmission loss of the electromagnetic wave in the dielectric is always greater than a transmission loss of the electromagnetic wave in the air, to reduce the propagation of the electromagnetic wave in the dielectric is to reduce a meaningless loss and increase transmit power. Radiation efficiency of the horn antenna 300 provided in this embodiment of the present invention can reach 98%.

Figure 5:
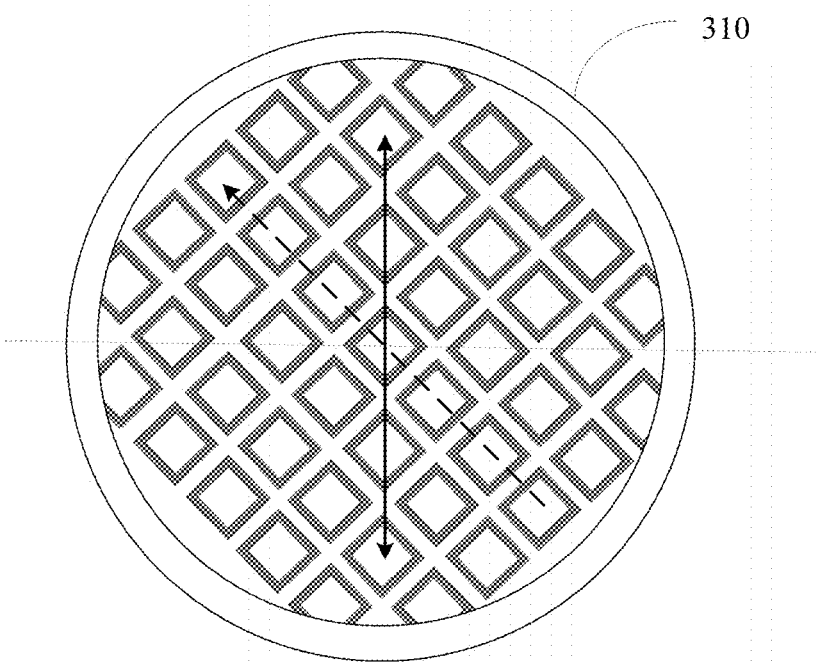
FIG. 5 is a diagram of a relationship between an FSS array arrangement direction in a horn antenna and an incident electromagnetic wave polarization direction according to an embodiment of the present invention.

Optionally, in another embodiment, an array arrangement direction of the FSS 310 is 45 degrees or 135 degrees to a polarization direction of an incident electromagnetic wave. As shown in FIG. 5, a solid line arrow represents a polarization direction of the incident electromagnetic wave, and a dashed line arrow represents the array arrangement direction of the FSS 310. Because the electromagnetic wave is usually a sine wave, there are two electromagnetic wave polarization directions that have an angle difference of 180 degrees, as shown by the arrows at both ends of a solid line in FIG. 4. Therefore, the array arrangement direction of the FSS 310 is 45 degrees to the polarization direction of the incident electromagnetic wave at a moment, and may be 135 degrees to the polarization direction at a next moment. The arrangement manner proposed in this embodiment of the present invention can reduce a side lobe height of a transmitted electromagnetic wave.

Figure 6:
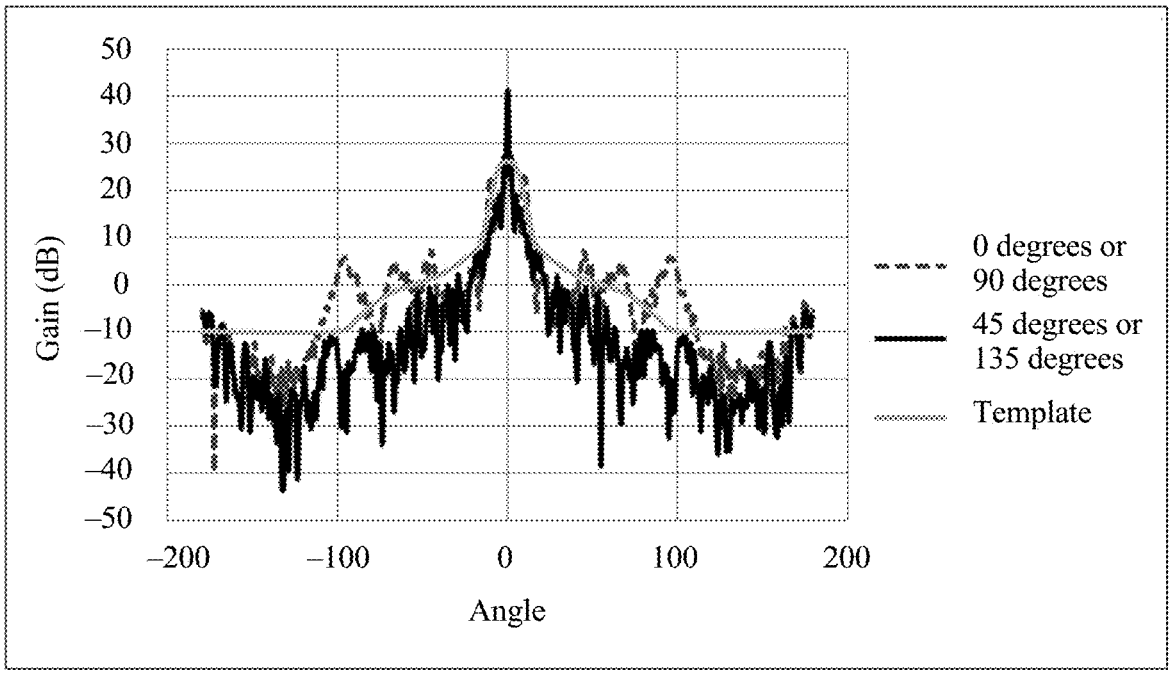
FIG. 6 is a diagram of a comparison between electromagnetic wave patterns obtained after an electromagnetic wave is separately transmitted through an existing FSS and an FSS in a horn antenna provided in the present invention.

Specifically, in an example in which a low frequency electromagnetic wave transmitted by the horn antenna 300 is incident on the FSS 310, when this incident electromagnetic wave is transmitted through the FSS 310, an induced current is generated on a surface of the FSS 310, and a scattered electromagnetic wave generated by the induced current interacts with the incident electromagnetic wave, to form a transmitted electromagnetic wave. When the array arrangement direction of the FSS 310 is consistent (0 degrees) with or perpendicular (90 degrees) to a polarization direction of the incident electromagnetic wave, no induced current is generated on metal on both sides of a gap that is consistent with the polarization direction, induced currents are generated on metal on both sides of a gap that is perpendicular to the polarization direction, and a scattered electromagnetic wave generated in this case is asymmetric in relative to the polarization direction of the incident electromagnetic wave. In this case, a pattern change result obtained after the transmitted electromagnetic wave passes through the FSS 310 is shown in FIG. 6, and cannot meet a radiation pattern envelope (RPE) template specified by the European Telecommunications Standards Institute (ETSI). However, when the array arrangement direction of the FSS 310 is 45 degrees or 135 degrees to the polarization direction of the incident electromagnetic wave, induced currents are generated on metal on both sides of gaps in the foregoing two directions, and a scattered electromagnetic wave formed in this case is symmetric in relative to the polarization direction of the incident electromagnetic wave. In this case, a pattern change result obtained after the transmitted electromagnetic wave passes through the FSS is shown in FIG. 6. This can greatly reduce a degradation degree of a beam shape of the transmitted electromagnetic wave, reduce a side lobe height of the transmitted electromagnetic wave, and meet the RPE template specified by the ETSI. In addition, in comparison with an existing arrangement direction (0 degrees or 90 degrees), energy is more concentrated, directivity of the horn antenna 300 is improved, and interference to a surrounding site is reduced.

Optionally, another part of the waveguide tube 330 is inserted into the connection structure 320. A distance from the waveguide tube 330 to the first dielectric slab 321 needs to be determined according to both a curvature of the first surface of the first dielectric slab 321 and a phase center of the horn antenna 300. Because the FSS 310 needs to be used as a secondary reflector of the dual-band parabolic antenna, the phase center of the horn antenna 300 and a virtual focus of the FSS 310 need to be overlapped. The FSS 310 covers the first surface of the first dielectric slab 321, and a curvature of the FSS 310 is consistent with that of the first surface of the first dielectric slab 321. Therefore, a position of the virtual focus of the FSS 310 may be determined according to the curvature of the first surface of the first dielectric slab 321. The phase center is a theoretical point, and a center of signals radiated by the antenna is considered as the phase center of the antenna. However, because an actual antenna cannot be perfectly prepared, a phase center of the actual antenna is usually a region. In this embodiment of the present invention, the phase center of the horn antenna 300 may be changed by adjusting a specific shape of the dielectric wall 323 or the distance from the waveguide tube 330 to the first dielectric slab 321, so as to overlap the virtual focus of the FSS 310 and the phase center of the antenna.

In addition, the horn antenna 300 further includes a choke groove 340, located around the waveguide tube 330 inserted into the hollow structure. A groove depth of the choke groove 340 is ¼ of a wavelength corresponding to a first frequency in the air. The first frequency is a transmission band center frequency of the FSS 310. The choke groove 340 can suppress transverse propagation of a surface current around the waveguide tube 330 inserted into the hollow structure, so that energy of the transmitted electromagnetic wave can be radiated forward in a more concentrated manner, to improve the radiation efficiency of the horn antenna 300. Further, there is more than one choke groove 340, and a groove spacing between multiple choke grooves 340 is 1/10 of the wavelength corresponding to the first frequency in the air. In this embodiment, if the horn antenna 300 includes multiple choke grooves 340, the energy of the transmitted electromagnetic wave can be further concentrated and radiated forward, so as to improve the radiation efficiency of the horn antenna 300.

It should be noted that, a larger quantity of choke grooves 340 may not indicate a better effect. A first choke groove 340 that is closest to the waveguide tube 330 has a most obvious effect. From a second to an $N^{th}$ choke grooves 340, distances to the waveguide tube 330 progressively increase, and effects progressively degrade. The quantity of choke grooves 340 needs to be determined according to an actual case, and is not limited in this embodiment of the present invention.

It should be noted that a relationship between a frequency (f) and a wavelength (λ) is $v=f\times\lambda$, and v represents a speed of light in a dielectric. In vacuum, v is equal to the speed of light, that is, $3\times10^8$ m/s. In a dielectric, v is related to a refractive index of the dielectric. If the refractive index of the dielectric is n, v=Speed of light/n.

Optionally, in another embodiment, the thickness of the first dielectric slab 321 is half of a wavelength corresponding to the first frequency in the first dielectric slab 321. The first frequency is the transmission band center frequency of the FSS. In this case, if the thickness of the first dielectric slab 321 is unchanged, curvatures of the first surface and the second surface that are of the first dielectric slab 321 are definitely consistent.

Because low frequency transmission bandwidth of the FSS 310 is related to the thickness of the first dielectric slab 321, when the thickness of the first dielectric slab 321 is half of the dielectric wavelength corresponding to the first frequency, reflection generated on the first surface of the first dielectric slab 321 is mutually offset with that generated on the second surface of the first dielectric slab 321 (the reflection generated on the first surface and that generated on the second surface have a same amplitude and opposite phases) in a process in which a low frequency electromagnetic wave is propagated from the air to a dielectric and then to the air. This can increase the low frequency transmission bandwidth of the FSS 310. Therefore, the thickness of the first dielectric slab 321 in this embodiment of the present invention is half of the dielectric wavelength corresponding to the first frequency. In comparison with another thickness, the low frequency band transmission bandwidth can be increased.

Figure 7:
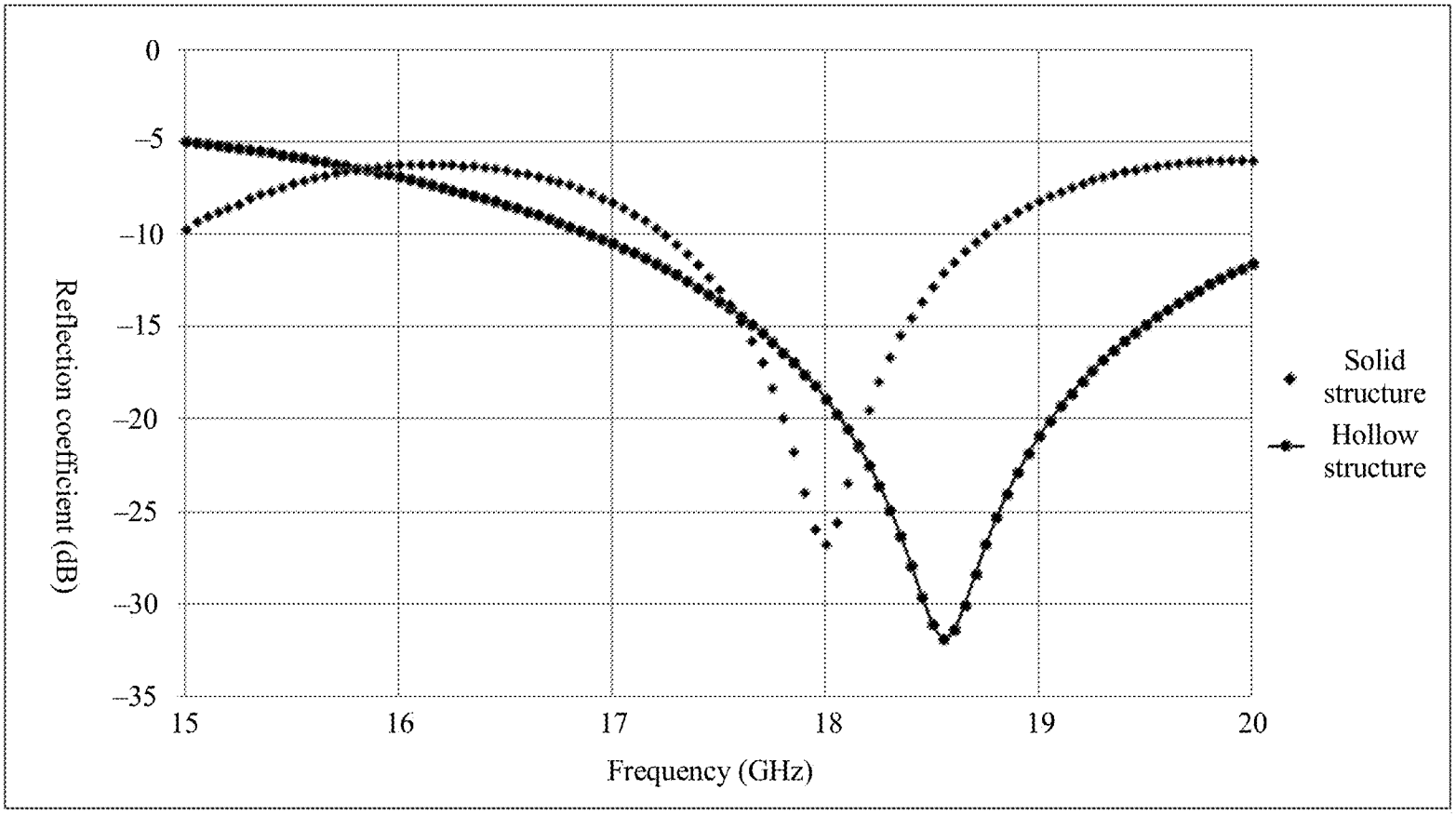
FIG. 7 is a diagram of a comparison between reflection coefficients of low frequency band electromagnetic waves after the low frequency band electromagnetic waves are respectively transmitted through a horn antenna using a hollow connection structure and a horn antenna using a solid connection structure.

In addition, except that the connection structure 320 with the hollow structure can reduce an electromagnetic wave loss and improve the radiation efficiency of the horn antenna 300, a reason that the connection structure 320 uses the hollow structure instead of a solid structure in this embodiment of the present invention is further related to the low frequency band transmission bandwidth. FIG. 7 shows a reflection coefficient of the FSS for a low frequency band electromagnetic wave. It can be learned from the figure that, when a solid dielectric is used, FSS transmission bandwidth is approximately 1 GHz (a reflection coefficient is below −15 dB). When the hollow structure in this embodiment of the present invention is used, the FSS transmission bandwidth can reach approximately 1.85 GHz. The low frequency band transmission bandwidth can be significantly increased.

In conclusion, a low frequency horn feed is integrated with an FSS in this embodiment of the present invention, so as to greatly reduce an error of alignment with a high frequency horn feed. A connection structure 320 with a hollow structure is used to reduce propagation of an electromagnetic wave in a dielectric as much as possible, so as to reduce a meaningless loss and improve radiation efficiency of a horn antenna 300. In addition, in comparison with a solid dielectric, by using the hallow structure, larger low frequency band transmission bandwidth can be obtained. In this embodiment of the present invention, an array arrangement direction of the FSS 310 is 45 degrees or 135 degrees to a polarization direction of an incident electromagnetic wave. This can alleviate degradation of a beam shape of the transmitted electromagnetic wave, and reduce a side lobe height of the transmitted electromagnetic wave, so as to improve directivity of the horn antenna 300, and reduce interference with a surrounding site.

The foregoing descriptions are merely specific implementations of the present invention, but are not intended to limit the protection scope of the present invention. Any variation or replacement readily figured out by a person skilled in the art within the technical scope disclosed in the present invention shall fall within the protection scope of the present invention. Therefore, the protection scope of the present invention shall be subject to the protection scope of the claims.

What is claimed is:

1. A horn antenna, comprising a frequency selective surface (FSS), a connection structure, and a waveguide tube, wherein the connection structure comprises a first dielectric slab, a second dielectric slab, and a dielectric wall, a first surface of the first dielectric slab is a hyperboloid whose surface is protruding, a second surface of the first dielectric slab is connected to the dielectric wall, a spacing between the first surface and the second surface of the first dielectric slab is a thickness of the first dielectric slab, the dielectric wall has a tubular structure, a first surface of the dielectric wall is covered by the first dielectric slab, a second surface of the dielectric wall is covered by the second dielectric slab, a spacing between the first surface and the second surface of the dielectric wall is a height of the dielectric wall, an area of the first surface of the dielectric wall is not less than an area of the second surface of the dielectric wall, the second dielectric slab has a hole at a middle position of the second dielectric slab, and the first dielectric slab, the dielectric wall, and the second dielectric slab jointly form a hollow structure; the FSS is integral with the connection structure and covers the first surface of the first dielectric slab; and the waveguide tube is inserted into the hole of the second dielectric slab.

2. The horn antenna according to claim 1, wherein an array arrangement direction of the FSS is 45 degrees or 135 degrees to a polarization direction of an incident electromagnetic wave.

3. The horn antenna according to claim 1, wherein the thickness of the first dielectric slab is half of a wavelength corresponding to a first frequency in the first dielectric slab, and the first frequency is a transmission band center frequency of the FSS.

4. The horn antenna according to claim 1, wherein the waveguide tube extends into the hollow structure.

5. The horn antenna according to claim 4, wherein the horn antenna further comprises a choke groove located around the waveguide tube inserted into the hollow structure, a groove depth of the choke groove is ¼ of a wavelength corresponding to a first frequency in air, and the first frequency is a transmission band center frequency of the FSS.

6. The horn antenna according to claim 5, wherein the horn antenna comprises more than one choke grooves, and a spacing between the choke grooves is 1/10 of the wavelength corresponding to the first frequency in air.

7. A dual-band parabolic antenna, comprising a high frequency feed, a primary reflector a horn antenna, wherein the horn antenna comprises a frequency selective surface (FSS), a connection structure, and a waveguide tube, and wherein the connection structure comprises a first dielectric slab, a second dielectric slab, and a dielectric wall, a first surface of the first dielectric slab is a hyperboloid whose surface is protruding, a second surface of the first dielectric slab is connected to the dielectric wall, a spacing between the first surface and the second surface of the first dielectric slab is a thickness of the first dielectric slab, the dielectric wall has a tubular structure, a first surface of the dielectric wall is covered by the first dielectric slab, a second surface of the dielectric wall is covered by the second dielectric slab, a spacing between the first surface and the second surface of the dielectric wall is a height of the dielectric wall, an area of the first surface of the dielectric wall is not less than an area of the second surface of the dielectric wall, the second dielectric slab has a hole at a middle position of the second dielectric slab, and the first dielectric slab, the dielectric wall, and the second dielectric slab jointly form a hollow structure;

the FSS is integral with the connection structure and covers the first surface of the first dielectric slab; and a part of the waveguide tube is inserted into the hole of the second dielectric slab.

* * * * *